US008808104B2

(12) United States Patent
Foster et al.

(10) Patent No.: US 8,808,104 B2
(45) Date of Patent: Aug. 19, 2014

(54) MODULAR GOLFING SYSTEM

(76) Inventors: Roland Foster, Detroit, MI (US); Rolando Foster, Detroit, MI (US)

( * ) Notice: Subject to any disclaimer, the term of this patent is extended or adjusted under 35 U.S.C. 154(b) by 180 days.

(21) Appl. No.: 13/549,124

(22) Filed: Jul. 13, 2012

(65) Prior Publication Data

US 2013/0017899 A1 Jan. 17, 2013

Related U.S. Application Data

(60) Provisional application No. 61/508,282, filed on Jul. 15, 2011.

(51) Int. Cl.
*A63B 53/02* (2006.01)

(52) U.S. Cl.
USPC ..... 473/288; 473/307

(58) Field of Classification Search
USPC ..... 473/288, 307, 298–299
See application file for complete search history.

(56) References Cited

U.S. PATENT DOCUMENTS

| | | | | | |
|---|---|---|---|---|---|
| 782,955 | A | | 2/1905 | Emens | |
| 796,802 | A | * | 8/1905 | Brown | 473/307 |
| 1,623,523 | A | * | 4/1927 | Bourke | 473/307 |
| 1,946,134 | A | * | 2/1934 | Dyce | 473/307 |
| 3,848,737 | A | | 11/1974 | Kenon | |
| 4,597,577 | A | * | 7/1986 | Lamanna | 473/307 |
| 4,664,382 | A | | 5/1987 | Palmer et al. | |
| 4,852,782 | A | | 8/1989 | Wu et al. | |
| 5,367,891 | A | * | 11/1994 | Furuyama | 63/29.2 |
| 5,433,442 | A | | 7/1995 | Walker | |
| 5,722,901 | A | * | 3/1998 | Barron et al. | 473/305 |
| 6,547,673 | B2 | | 4/2003 | Roark | |
| 6,979,269 | B1 | * | 12/2005 | Nohara | 473/244 |
| 7,736,243 | B2 | | 6/2010 | Sanchez et al. | |
| 7,815,519 | B2 | * | 10/2010 | Bryant et al. | 473/288 |
| 7,976,401 | B2 | | 7/2011 | Sato et al. | |
| 8,142,307 | B2 | | 3/2012 | Sanchez et al. | |
| 8,568,246 | B2 | * | 10/2013 | Wall et al. | 473/296 |
| 2005/0130757 | A1 | * | 6/2005 | Tucker | 473/288 |
| 2006/0264266 | A1 | | 11/2006 | Jung | |
| 2006/0281576 | A1 | * | 12/2006 | McDuffee | 473/313 |
| 2008/0153619 | A1 | * | 6/2008 | Tucker et al. | 473/288 |
| 2010/0056290 | A1 | * | 3/2010 | Smith | 473/288 |
| 2011/0263348 | A1 | * | 10/2011 | Sato | 473/307 |

FOREIGN PATENT DOCUMENTS

| | | | | | |
|---|---|---|---|---|---|
| JP | 2000042151 | A | * | 2/2000 | A63B 53/06 |

* cited by examiner

*Primary Examiner* — Stephen L. Blau
(74) *Attorney, Agent, or Firm* — Carlson, Gaskey & Olds P.C.

(57) ABSTRACT

A golf club system includes a club head and a shaft. The club head has a column extending upwardly therefrom, the column having a tooth extending radially outwardly therefrom, the tooth having a first magnet attaching thereto. The shaft has a wall defining a hollow portion that receives the column, the wall having a slot therein the slot having an insertion portion through which the tooth may slide axially and an attachment portion in which the tooth may rotate circumferentially after passing through the insertion portion and a second magnet that engages the first magnet in the tooth after the tooth rotates circumferentially away from the slot.

15 Claims, 3 Drawing Sheets

MODULAR GOLFING SYSTEM

CROSS-REFERENCE TO RELATED APPLICATION

This application claims priority to U.S. Provisional Ser. No. 61/508,282, filed on Jul. 15, 2011.

BACKGROUND

This disclosure relates to golf clubs and more particularly to a golf shaft or shafts having interchangeable heads.

Golfing can be difficult to play not just for the skill required but because the golf equipment necessary to play is difficult to lug around a golf course. One who may want to walk the course may not be able to because the fourteen clubs allowed to be carried along with other golf paraphernalia like balls, tees, etc. are simply too heavy to carry. The golfer may then be forced to rent a golf cart and give up the opportunity to walk the course while significantly increasing the cost of the round by renting the cart.

Some modular club systems exist in which the club heads are detachable from a shaft. However, the existing systems are difficult to assemble and take apart quickly.

SUMMARY

According to an embodiment disclosed herein, a golf club system includes a club head and a shaft. The club head has a column extending upwardly therefrom, the column having a tooth extending radially outwardly therefrom, the tooth having a first magnet attaching thereto. The shaft has a wall defining a hollow portion that receives the column, the wall having a slot therein the slot having an insertion portion through which the tooth may slide axially and an attachment portion in which the tooth may rotate circumferentially after passing through the insertion portion and a second magnet that engages the first magnet in the tooth after the tooth rotates circumferentially away from the slot.

According to a further embodiment disclosed herein, a method of attaching and detaching a shaft from a club head, includes the steps of providing a first club head having a column extending upwardly therefrom, the column having a tooth extending radially outwardly therefrom, the tooth having a first magnet attaching thereto, providing a shaft, the shaft having a slot therein, rotating the tooth circumferentially within the slot about the shaft, and engaging the first magnet of the tooth with the second magnet.

Although the different examples have the specific components shown in the illustrations, embodiments of this invention are not limited to those particular combinations. It is possible to use some of the components or features from one of the examples in combination with features or components from another one of the examples.

BRIEF DESCRIPTION OF THE DRAWINGS

This disclosure can be further understood by reference to the following detailed description when considered in connection with the accompanying drawings, wherein.

DETAILED DESCRIPTION

Figure 1:
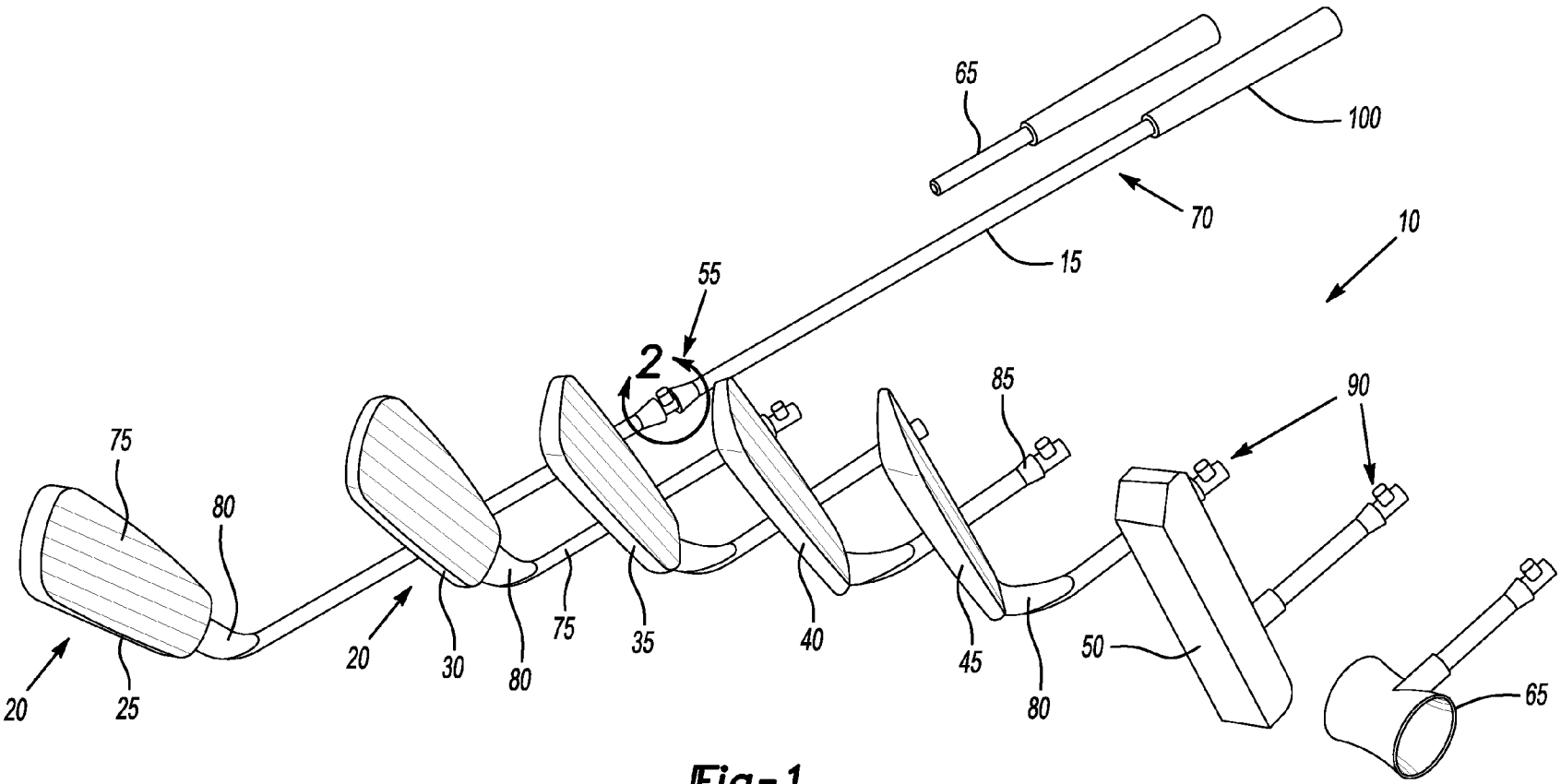
FIG. 1 is a perspective view of a modular golf system described herein.
Figure 4:
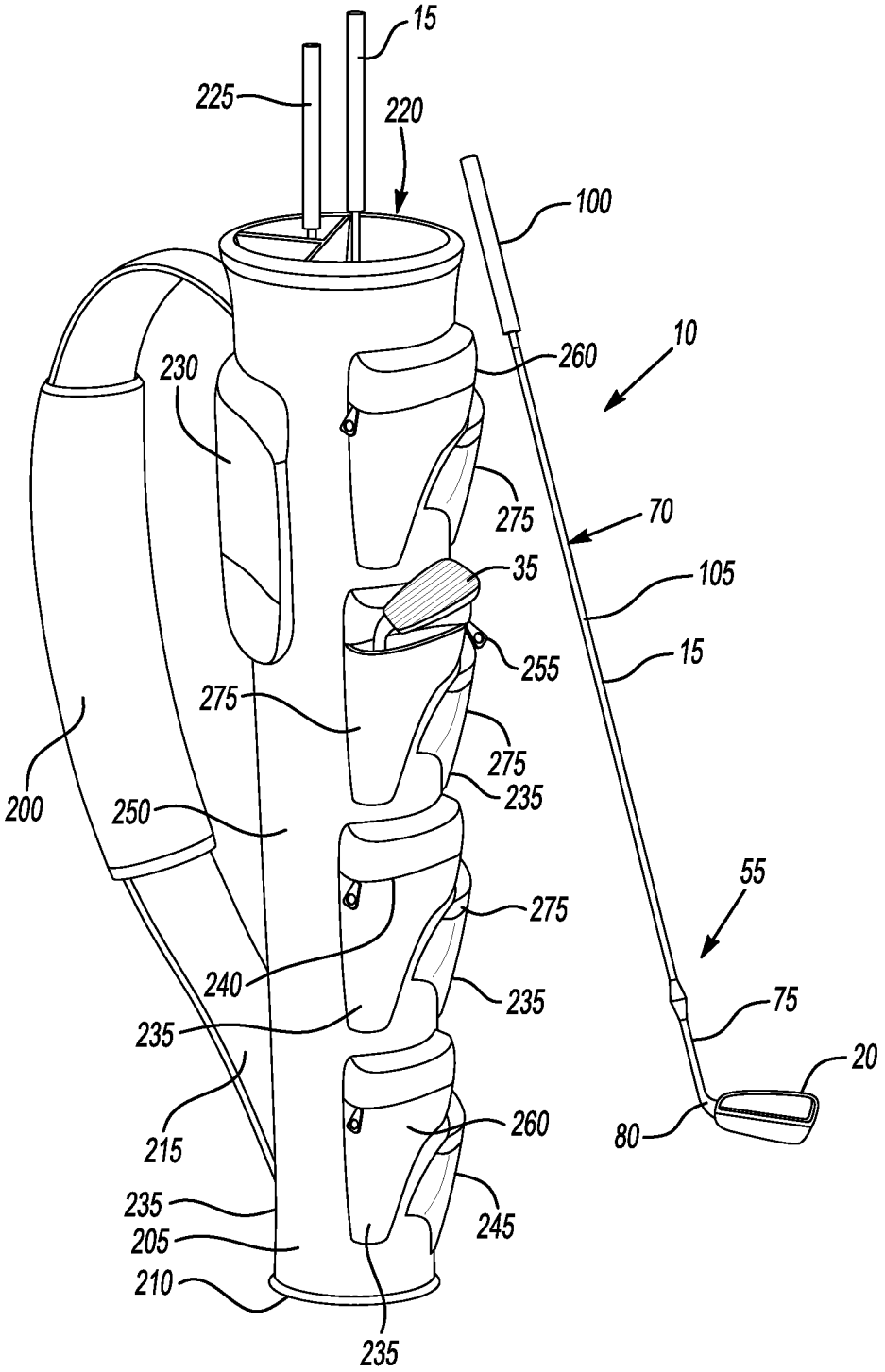
FIG. 4 is a perspective view of a golf bag for use with the modular golf system of FIG. 1.

FIGS. 1 and 4 illustrate a modular golf system 10. The golf system 10 includes a shaft 15 and a plurality of club heads 20 including driving iron club head 25, 3 iron club head 30, 7 iron club head 35, 9 iron club head 40, pitching wedge club head 45 and putter club head 50. The club heads 20 are each attached to the shaft 15 by a joint 55. The club heads 20 and the shaft 15 are stored in a lightweight golf bag 60 as will be discussed infra. Other clubs heads such a wedge(s), a driver, a chipper, a hybrid, a wood or other heads used in golfing may be used by utilizing the teachings provided herein. In fact, a utility head such as a ball retriever club head 65 may also be used. A second (or more) upper shaft 70 that may be shorter, longer or extending for use with a belly putter or for the ball retriever club head 65, or the like, incorporating a joint 55, may also be included.

Each club head 20 includes a club head 20, a lower shaft 75 and a hosel 80 that connects the lower shaft 75 to the club head 20. The lower shaft 75 has a flared portion 85 at an end distal from the hosel 80. The flared portion 85 creates a shoulder 90 that interacts with the upper shaft 15 as will be discussed infra. A keyed portion 95 extends beyond the flared portion 85 and is coaxial with the lower shaft 75. Each upper shaft 15 includes a grip 100 and an elongated portion 105 that also terminates at the joint 55 as will be discussed infra.

The lower shaft 75 of each club head 20 may be longer or shorter than the other club heads given the requirements of the game. For instance, the club heads 20 for the lower numbered clubs are generally longer than the club heads 20 for the higher numbered club heads. So the club head 45 for a wedge has a lower shaft 75 that is shorter than the lower shaft 75 for the nine iron club head 40 which is shorter than the 7 iron club head 35 etc. This is not to say that the lower shafts 75, as in some golfing systems, cannot be equal in length or different in length in other ways.

Figure 2:
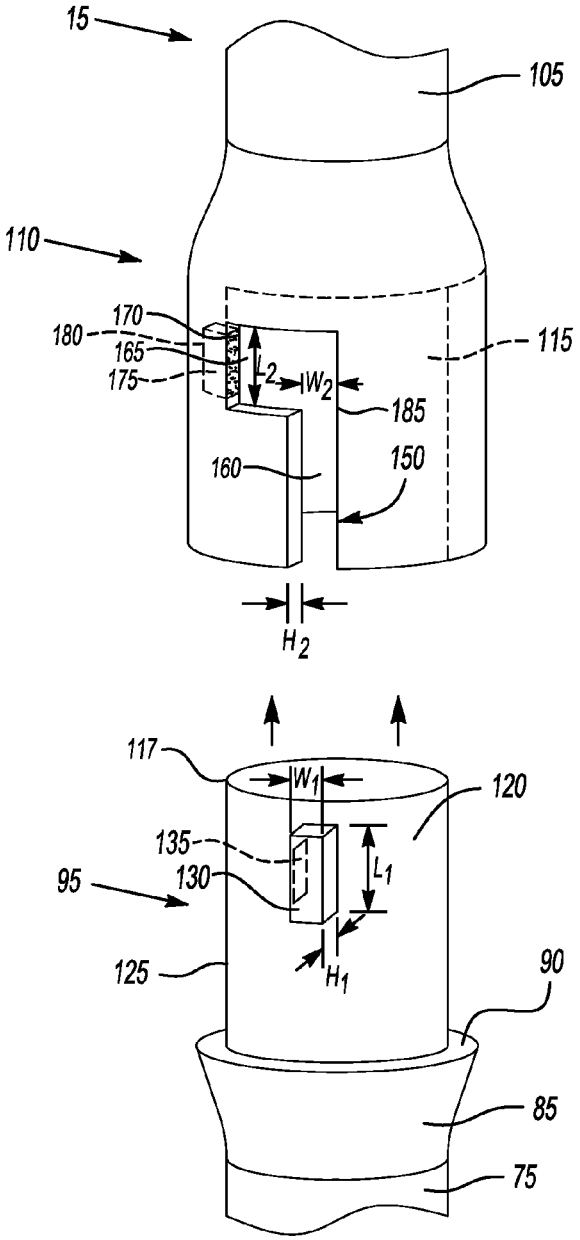
FIG. 2 is a an exploded perspective view of a disassembled golf club taken along the line 2-2 of FIG. 1.
Figure 3:
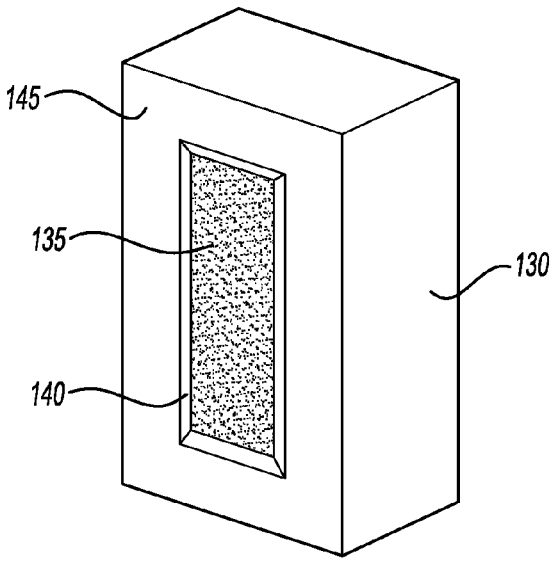
FIG. 3 is a view of a tooth used in FIG. 2.

Referring now to FIGS. 2 and 3, the joint 55 is described. The upper shaft 15 terminates in a wider portion 110 than the width of the upper shaft 15. A hollowed portion 115 in which the keyed portion 95 extends forms a mild interference fit therein such that the keyed portion may be inserted, rotated coaxially and removed. The interference fit can be defined as one in which the key portion may not move if undisturbed in the hollowed portion 115 but will move if force beyond the force gravity is added. An end 120 of the keyed portion 95 may have a chamfer 117 to allow easier insertion into the hollowed portion 115. The keyed portion 95 includes a column 125 that extends beyond and coaxially with the shoulder 90.

A tooth 130 extends radially outwardly from the column 125 that fits in the hollowed portion 115. The tooth has a width $W_1$, a height $H_1$ and a length $L_1$. A first magnet 135, which may be permanent and made of a durable alloyed rare earth material including neodymium, or the like, is attached by cementing or the like, into place in an indentation 140 in a side 145 of the tooth 130. As shown in FIG. 3A, the first magnet 135 is recessed into the indentation 140 to minimize a force of a golf club swing on the first magnet 135. Such force would be carried by the tooth 130 to wall 170 in the wider portion 110. The first magnet 135 may also be cemented to the side 145 and not be placed in an indentation 140.

Referring back to FIG. 3, the wider portion 110 of the elongated portion 105 has a slot 150. The slot has a width $W_2$ that is roughly equal to the width $W_1$, and a height $H_2$ that is equal or greater than the height $H_2$ so that if the tooth is inserted in the slot 150, the tooth height $H_1$ is equal to a the height $H_2$ of the surface 155 of the wider portion 110 or extends there beyond such that a mild interference fit as defined above exists. The slot 150 is defined by an insertion portion 160 extending through the wider portion 110 and an open attachment portion 165 that extends circumferentially around and through the wider portion 110 from the insertion portion 160. The insertion portion 160 has a length $L_2$ that forms a mild interference fit, as above, with the length $L_1$ of the tooth 130.

The slot attachment portion 165 terminates in a wall 170 of the wider portion 110. A second magnet 175, which may also be permanent, is attached within a recess 180 in the wall 170. As above, the second magnet 175 may be recessed in the recess 180 or attached to the wall 170. One of the first magnet 135 and the second magnet is arranged so that its positive pole faces away from the wall 170 and the other of the first magnet 135 and the second magnet is arranged so that its negative pole faces away from the side 145 of the tooth 130. The first and second magnets 135, 175 will then attract each other during operation because positive pole and a negative pole attract one another. The joint 55 is defined by: the hollowed portion 115 of the wider portion 110, the slot 150, and the second magnet 175 in the wall 170 in the shaft 15; and by the tooth 130, the first magnet 135, the column 125, the shoulder 90, and the flared portion 85 of the club head 20.

To mount a club head 20 to a shaft 15, a golfer chooses a club head 20 for a required shot or other particular use. For instance, if the required shot is under one hundred yards, the golfer may choose a wedge club head 45 and if the ball is on a green (not shown), the golfer may choose a putter club head 50. The golfer grasps the putter club head 50, inserts the column 125 within the hollowed portion 115, aligns the tooth 130 with the insertion portion 160 of the slot 150, slides the tooth through the insertion portion 160 until the tooth contacts the wider portion and until the shoulder 90 contacts the wider portion 110 (which happens simulataneously), and rotates either the club head 50 or the shaft 15 so that the tooth moves circumferentially in the attachment portion 165 of the slot 150 until the side 145 of the tooth 130 engages the wall 170 in the wider portion 110. At this point the first and second magnets 135, 175 ensure that the tooth 130 does not disengage from the wall 170. In the instant example, the tooth 130 rotates counter-clockwise relative to the shaft 15, so that impact with a golf ball (or turf or sand or a ball washer—not shown) by a club head 20 does not cause a club head 20 to disengage the magnets 135, 170 for a right-handed golfer. As one of ordinary skill in the art can appreciate, if a golfer is left-handed, the slot 150 would be arranged so that clockwise rotation of the tooth 130 is required.

Once a shot is completed and another club head 20 is desired, e.g., the golfer is done putting and is ready to select another club head 20, the process is reversed. The right-handed golfer, the club head 50 is rotated clockwise relative to the shaft 15 so that the tooth 130 moves thereby disengaging the magnets 135, 175 and the tooth engages wide portion wall 185. The tooth 130 is then slid through the insertion portion 160 and the column 125 disengages the hollowed portion 115. Another club head, such as driving iron club head 25 may be coupled to the shaft 15.

Referring now to FIG. 4, golf bag 60 is shown. The bag 60 has a shoulder strap 200 attached at either end to a body 205. Though the body 205 is shown as cylindrical, other shapes are contemplated herein. The bag 60 has a plurality of holster-shaped outer pockets 210 attached to an outer surface 215 of the bag 60. The interior 220 of the bag 60 is hollow so that the shaft 15 or other shafts may be carried therein. The bag is lighter because the golfer does not have to carry fourteen shafts due to the unique nature of the joint 55 described herein, only one shaft 15 is necessary for a golfer to carry. The bag 60 may have other pockets 230 to carry balls, tees, markers, divot tools, distance lens, etc. (not shown) as may be necessary.

The pockets 210, which may be holster-shaped, have an elongated section 235 for fitting the lower shafts 75 therein and a wider portion 240 extending above the elongated section 235 for fitting the club head 20 therein. To protect the club heads 20 from the elements, the wider portion may be capped by a cover 245 that attaches to the outside surface 250 of the pocket 210 by a zipper 255. Indicia 260 may be placed on each pocket 210 to enable a golfer to properly store and select each club head 20. The elongated sections 235 are sized to accommodate a length of each lower shaft 75. In other words, the elongated sections 235 are longer for a 3 iron club head 30 than for a 9 iron club head 40. The pockets may be aligned (e.g., for pockets with club heads for a 2, 3, 7 and 9 iron) in such a way that the lengths of the lower shafts 75 for each column of pockets equal the lengths of the lower shafts 75 for other aligned pockets (as for the club heads for a driver "D", 4, 6, pitching wedge "PW" that may equal the club heads for the 2, 3, 7 and 9 iron) to maximize space on the surface 250 of the bag 60. The pockets 210 may also interleave such that pockets 210 aligned in a first column 260 may have each pocket with the wider portion 240 extending to the right (as seen in FIG. 4) and the second column 270 may have pockets 210 with their wider portions 275 extending to the left and below the wider portions 240 of the first column 260 to create a staggering of the pockets 210 in the first column 260 and the second column 270. This staggering allows for the placement of more club heads 20 on the bag 60.

The applicants have discovered that the prior art systems have mechanical connections that tend to wear over time creating tolerances (slop) in the joints. This slop may cause the joints to loosen thereby lessening the feel a golfer expects when hitting the ball because of relative motion in the joints. The golfer may also lose power because of energy absorbed in the joint due to relative motion therein. The joints may also cause noise. Because the embodiments shown herein use first and second magnets, which may be permanent, even if the mild interference fits are loosened by wear, the first and second magnets 135, 175 will keep the tooth 130 in contact with the wider portion 110 so that there is minimal or no movement in the joint 55 to enhance feel, minimize noise, maximize power and maximize the golfing experience over time.

Although an example embodiment has disclosed, a worker of ordinary skill in the art would recognize that certain modifications would come within the scope of the claims. For example, any feature of the various examples described above may be used with any other feature of a different example. For that reason, the following claims should be studied to determine their true scope and content.

What is claimed is:

1. A golf club system comprising:

a first club head and a shaft wherein one of said first club head and said shaft has a column extending therefrom, said column having a tooth extending radially outwardly therefrom, said tooth having a first magnet attaching thereto, and wherein another of said first club head and said shaft has a wall defining a hollow portion that receives said column, said wall having a slot therein said slot having an insertion portion through which said tooth may slide axially and an attachment portion in which said tooth may rotate circumferentially after passing through said insertion portion and a second magnet that engages said first magnet in said tooth after said tooth rotates circumferentially away from slot.

2. The system of claim 1 wherein said first magnet and said second magnet are permanent magnets.

3. The system of claim 1 wherein one of said first magnet or said second magnet has a negative pole that engages the positive pole of the other of said first magnet or said second magnet.

4. The system of claim 1 wherein said second magnet is attached to said wall.

5. The system of claim 4 wherein said second magnet is recessed within said wall.

6. The system of claim 1 wherein said first magnet is attached to a side of said tooth that abuts said column.

7. The system of claim 6 wherein said first magnet is recessed within said side.

8. The system of claim 1 wherein said shaft has an extended portion that is narrower radially than said wall.

9. The system of claim 8 wherein said column attaches to a flared portion of said club head, said flared portion forming a shoulder that abuts said wall if said tooth extends through said insertion portion.

10. The system of claim 1 wherein if said tooth abuts said wall, said first magnet attracts said second magnet but said first magnet and said second magnet are not in contact with each other.

11. The system of claim 1 further comprising:

a golf bag, said golf bag having a hollow portion for storing said shaft and more than one exterior pocket attached to said bag, each of said pockets having a wide upper portion and a narrow lower portion, said lower portion removeably housing said column and said upper portion removeably housing said club head.

12. The system of claim 11 further comprising each of a first plurality of said pockets are arranged in a first column.

13. The system of claim 12 further comprising each of a second plurality of said pockets are arranged in a second column.

14. The system of claim 13 wherein each of said first plurality of said pockets are interleaved with each of a second plurality of said pockets arranged in said second column.

15. The system of claim 14 wherein a wider portion of each of said first plurality of said pockets are disposed above a wider portion of each of said second plurality of said pockets arranged in said second column.

* * * * *